US005649682A

United States Patent [19]

Martin

[11] Patent Number: 5,649,682

[45] Date of Patent: Jul. 22, 1997

[54] SIMPLIFIED CONTAINER HOLDER FOR A LADDER WITH HOLLOW RUNGS

[76] Inventor: Julius F. Martin, 2335 Easter La., New Orleans, La. 70114

[21] Appl. No.: 232,827

[22] Filed: Apr. 22, 1994

[51] Int. Cl.[6] ..... E06C 7/14

[52] U.S. Cl. ..... 248/210; 248/231.9; 248/300; 248/311.2

[58] Field of Search ..... 248/210, 211, 248/231.9, 311.2, 312.1, 313, 300

[56] References Cited

U.S. PATENT DOCUMENTS

| | | | |
|---|---|---|---|
| 1,256,909 | 2/1918 | Kroshaug | 248/210 |
| 2,550,554 | 4/1951 | Griffin . | |
| 3,104,859 | 9/1963 | Hoelzel | 248/210 |
| 3,160,383 | 12/1964 | Lamm | 248/211 |
| 3,313,506 | 4/1967 | Bauchard | 248/210 |
| 3,420,486 | 1/1969 | Baker | 248/210 |
| 3,857,537 | 12/1974 | Swalinkavich, Jr. . | |
| 4,186,903 | 2/1980 | Fazakerly | 248/210 |
| 4,395,013 | 7/1983 | Wissinger . | |
| 4,577,820 | 3/1986 | Michaud | 248/312.1 X |
| 4,824,060 | 4/1989 | Korda . | |
| 5,145,226 | 9/1992 | LaFontaine . | |
| 5,181,682 | 1/1993 | Indelicato . | |
| 5,191,954 | 3/1993 | Ledford . | |
| 5,293,957 | 3/1994 | Lunden, Jr. | 248/210 X |

FOREIGN PATENT DOCUMENTS

| | | |
|---|---|---|
| 695251 | 8/1940 | Germany . |
| 683720 | 12/1952 | United Kingdom . |
| 1544265 | 4/1979 | United Kingdom . |

OTHER PUBLICATIONS

Catalog Publication Sheet Entitled "Ladder 'Shelf' For Your Paint Can" Item 21006, Paint Can Caddy.

*Primary Examiner*—Derek J. Berger
*Attorney, Agent, or Firm*—C. Emmett Pugh; Pugh/Associates

[57] ABSTRACT

A container holder for supporting a container (12), such as, for example, a paint can, or other item, on a ladder (16) using the interior of a hollow ladder rung (18) for support, into which rung is inserted a flattened, rod-like, projecting arm (14) integrally formed with a completely encircling cincture (10) securing the container, with over-lapping members (14/14A) making up the arm held together under compression by a simple fastener (20) at the point where the cincture and the support arm members join. When unfastened, the cincture is placed around the circumference of the paint can either below the side handle protrusions (FIG. 4) or between them and the laterally extending top lip of the can (FIG. 5B), with the over-lapping arm members then being brought together in over-lapping fashion and fastened together. The integral cincture and the over-lapping projecting arm members are formed from one continuous strip of flat, flexible, preferably springy material which is rigid across its width and appropriately bent.

12 Claims, 3 Drawing Sheets

SIMPLIFIED CONTAINER HOLDER FOR A LADDER WITH HOLLOW RUNGS

TECHNICAL FIELD

This invention relates to a container holder and a related method of supporting a container, such as, for example, a paint can (or other item), on a ladder to have the container's contents handy to the worker standing on the ladder.

The preferred embodiment of the invention relates generally to a simplified container holder comprising a clamping circular band of a diameter or other cross-sectional size to securely engage around the circumference of, for example, a one gallon paint can, with the band being attached to a projecting arm of such size to fit well into the typical hollow rung of an aluminum ladder. In operation, the clamp is secured around the container, and the arm is thereafter inserted into the hollow center of a selected rung of the aluminum ladder. The can of paint or other container or item is thereby supported in a convenient location providing ease of access for, for example, a painter standing on the ladder.

BACK GROUND ART

As a do-it-yourselfer, the inventor searched for years to find a safe and handy method for keeping a paint can securely and conveniently located near the working area from a ladder.

Until a couple of years ago, the only article that the inventor found in a search of stores and catalogs was the traditional "hook and chain," which served the purpose very poorly.

The inventor initially rigged a shelf arrangement for his use that was supported between the two uprights of a ladder and hung from one rung and rested on the rung just below it. It worked well, and it was used until the inventor saw a "Paint Can Caddy" shelf in a catalog. (See catalog sheet listed in references below.)

The "caddy" did support the can closer to the painting area but required the "setting up" of the caddy with both hands and then the bringing up of the paint can. Changing locations took more time and effort. The inventor's original "shelf" was easier to change its position up or down the ladder than the caddy was. When changing the position of the caddy, the support rods therefor have fallen and had to be retrieved from the ground.

A list of prior patents which may be of interest is provided below:

| Patent No. | Inventor | Issue Date |
|---|---|---|
| 2,550,554 | Griffin | 04/24/51 |
| 3,857,537 | Swalinkavich, Jr. | 12/31/74 |
| 4,395,013 | Wissinger | 07/26/83 |
| 4,824,060 | Korda | 04/25/89 |
| 5,145,226 | LaFontaine | 09/08/92 |
| 5,181,682 | Indelicato | 01/26/93 |
| 5,191,954 | Ledford | 03/09/93 |
| 695,251 | Geyer (Germany) | 08/21/40 |
| 683,720 | Evans (Great Britain) | 12/03/52 |
| 1,544,265 | Davenport (Great Britain) | 04/19/79 |

Reference is also had to the catalog publication sheet entitled "Ladder' Shelf' For Your Paint Can", Item 21006, "Paint Can Caddy", the date of which is presently unknown but which preceded the making of the present invention.

Each of the references are discussed below in the numerical order listed above.

U.S. Pat. No. 2,550,554 to Griffin, which is from a non-analogous art, provides a portable receptacle support preferably on the neck and chest of a user for holding in front of the user a bowl or dish using two, opposed, encircling but arms split and held apart but having a tightening means at their distal ends, all with a structure and approach which does not lend itself to supporting a container from a ladder.

U.S. Pat. No. 3,857,537 to Swalinkavich, Jr. supports a paint pail on a ladder using two encircling, split arms tightened and held together at their distal ends by means of a wing nut and bolt arrangement, while the main arm of the holder is suspended along side and spaced from (not in) the ladder rung. The supporting arm or rung is not designed for insertion into a hollow ladder rung but is suspended on the outside of a selected ladder rung using a pair of hook elements. In contrast the preferred embodiment of the present invention has but a single, proximal tightening means and uses a continuous clamping band, with the band being formed in one, continuous circle, with its fastening attachment located at a proximal location and with the supporting arm, which is an integral extension and part of the continuous band, being inserted into the rung of the ladder.

U.S. Pat. No. 4,395,013 to Wissinger, which is also from a non-analogous art, is directed to a lantern holder using a encircling pair of over-lapping clamping arms including two, over-lapping pieces with a tightening means at their outer edge. Like Swalinkavich, the Wissinger device is not designed for inserting into a hollow rung of a ladder. The present invention has one tightening means at the point of the supporting arm, and the supporting arm is specifically designed for insertion into a hollow rung of a ladder.

U.S. Pat. No. 4,824,060 to Korda is directed to a paint can holder for hollow rung ladders and uses a fixed, circular band that does not have a tightening means and requires an additional lower support member or floor that passes under the paint can to prevent it from passing through the circular band. The present invention is simpler, less complicated, not nearly as bulky, lightweight, is easily passed around the container to be supported and, when tightened, effectively becomes an integral part of the container itself. The holder and the container of the invention are carried and moved about as a single, fastened-together unit.

Although Korda uses the hollow rung of a ladder to support its container, its support arm, which is not integral to the fixed band, is much longer than the invention and is designed to pass completely through the hollow rung of a ladder with a locking means on the side opposite to the container holder. Such an arm is cumbersome to handle, and likely requires the use of two hands to change the position of the holder on the ladder.

The present invention requires but one hand to change its location on the ladder by simply taking hold of the container's own handle and merely moving it away to the side away from the ladder, and the arm quickly and easily slides out of the hollow rung. To position it in the next convenient location, with the container in its holder, the holder is merely moved to the desired ladder rung, requiring the use of only one hand, and the arm of the holder is merely inserted into it.

U.S. Pat. No. 5,145,226 to LaFontaine, which is directed to a paint can holder, uses a rim clip that grips only a very small, peripheral portion of the rim of a standard paint can, and does not use a circular, completely encircling band as in the invention. LaFontaine does use the hollow rung of a ladder for supporting the holder (as does Korda, as well as Ledford, Evans and Indelicato discussed below). One significant problem with the over-the-top rim gripping attachment of LaFontaine is that the cover for the paint can not be placed on it with the clip attachment secured in position, while the present invention does allow the cover to be secured on to the can while its is in the grip of the invention's holder.

U.S. Pat. No. 5,181,682 to Indelicato is directed to a tool holder having a fixed, always closed, cylindrical section to hold the tool for use on a ladder and uses two, spaced, substantially parallel, flexible arms which are inserted into the hollow rung of the ladder, which flexible arms must be squeezed together for insertion into the rung. In contrast the present invention does not require any adjustment or squeezing for insertion and uses an openable ring for the holder.

U.S. Pat. No. 5,191,954 to Ledford uses a ladder's hollow rung as a partial support for an associated platform or shelf, which also requires an elaborate arrangement to be attached to the other side of the ladder rungs for support. Ledford's platform and utensil rack does not lend itself to ease of position change. In contrast the present invention provides a simple, effortless means to support a container from a hollow rung of a ladder.

The German publication 695,251 to Geyer apparently supports a lantern on a ladder-like structure using a hook and a bent piece of metal, which apparently clamps about the side of the ladder and only partially encircles the lantern with one side arms that are split and separated at their distal ends.

Great Britain Patent 683,720 to Evans uses a hollow rung for support of a paint can but does not use a circular clamp around the sides of the can but rather a separate but interconnected hook element hanging down from the support arm, which hook element hooks into the paint can handle.

Great Britain Patent 1,544,2654 to Davenport does not use a encircling ring or circular clamp but rather a rim clip, in similar fashion to LaFontaine, and the support is not by means of a hollow rung but rather with a longitudinally extended clamp gripping a side of the ladder.

Thus, the prior art has failed to fairly suggest or teach the present invention, which represents a substantial, utilitarian advance in the art by providing a holder formed from a single, integral, continuous piece of flexible, preferably springy, material, which completely encircles the container or paint can and extends into the hollow rung of a ladder for support, with the circle being completed on its proximal side with one end thereof being temporarily fastened and held to the extended, main body of the arm with simple fastening means, such as, for example, a wing nut and bolt arrangement with the arm members being over-lapped and compressed together outside of the circle.

GENERAL DISCUSSION OF INVENTION

The present invention is believed to be the simplest method for supporting and holding a container (e.g. a paint can) securely on a ladder and requires no additional accessories or parts except for a simple, small fastening means. The holder preferably consists of a circular band to be secured around the sides or circumference of the container, preferably with a single tightening means at a proximal point after the circle is completed, forming a clamping, face-to-face, surface engaging or tightening means. The holder further includes an extension of one side of the clamping band extending out from the band to form or become a supporting arm when inserted into a hollow rung of, for example, an aluminum ladder.

The container holder preferably is formed from a single, integral, continuous piece of flexible, preferably springy, strip material, which completely encircles the container or paint can and has an integral arm section which is positioned and extends into the hollow rung of a ladder for support, with the circle being completed on its proximal side, with the over-lapping ends thereof being temporarily fastened together under compression with a simple fastening means, such as, for example, a wing nut and bolt arrangement.

Several objects and advantages of the invention include:

(a) the ability to position a container most convenient and accessible to the working area from a ladder;

(b) providing a more secure means of supporting a container conveniently and safely on a ladder;

(c) a simple and easy method to move a container and its supports to a new location, up or down, on a ladder;

(d) an easy and simple means to change a container and its support from one side to the other side;

(e) the container and its supports are moved in a single operation, with the use of one hand only;

(f) the container remains in its support during all changes in location;

(g) only one hand is required to move the container and its support to any location;

(h) the containers handle or bail itself become the handle for carrying the support of the invention with the container intact;

(i) the container is easy and simple to place into the support of the invention or to remove from it;

(j) with the support of the invention attached to the container, the two become a single integral unit;

(k) with the container secured in the support of the invention, it occupies very little space for storage, etc.;

(l) the support and band holder of the invention itself is small and lightweight for easy handling and storage;

(m) the invention is preferably provided as a single, integral unit and does not involve separate parts to be assembled on site or elsewhere;

(n) the container's cover may remain secured on the container, or be removed, while the container is secured into the holder;

(o) no staging or setting up is required on the ladder before carrying the container to the working position on the ladder;

(p) the worker always has one hand for himself and one hand for the task of handling and changing the container's position on the ladder; and (q) when properly secured into the holder, the container hangs as a pendulum, thus always maintaining an upright, vertical disposition regardless of the angle of the ladder against the wall.

It is believed that a circular, completely encircling, contact band is the best means for securely holding a circular or cylindrical container. It is also believed that using the interior of a hollow ladder rung is the best way of supporting a container or other item holder on a ladder. Both of these goals have been achieved in the invention with a highly simplified, economical and easily manufactured structure.

The inventor searched for years for a better means for supporting a paint can from a ladder. A search of specialty stores and manufacturer's catalogues offered no tool or satisfactory product. Nothing vaguely similar to the tools was located in a search of the files of the U. S. Patent and Trademark Office.

Much thought and sketches with various approaches were put into the present invention before a prototype of the invention was developed and tested in actual use. The invention was made not to become a patented tool but for the convenience of working from a ladder.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 1 is a front view of a exemplary ladder (partially shown) with an exemplary, preferred embodiment of the simplified container holder of the present invention shown in use supported on the side of the ladder and holding a container (e.g. paint can), with the exterior of the rung being shown in cross-section to expose the support arm resting within it; while

FIG. 3 is a perspective, side view of the holder of FIG. 1, but without the container to better show the band, contact ring of the holder; while

BEST, EXEMPLARY MODE FOR CARRYING OUT THE INVENTION

Figure 2:
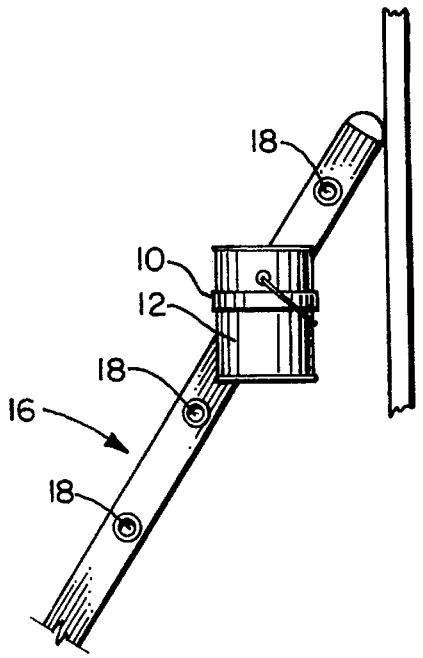
FIG. 2 is a side view of the embodiment and ladder of FIG. 1, showing how the holder automatically vertically aligns itself regardless of the angle of the ladder with respect to its support, typically a wall.
Figure 3:
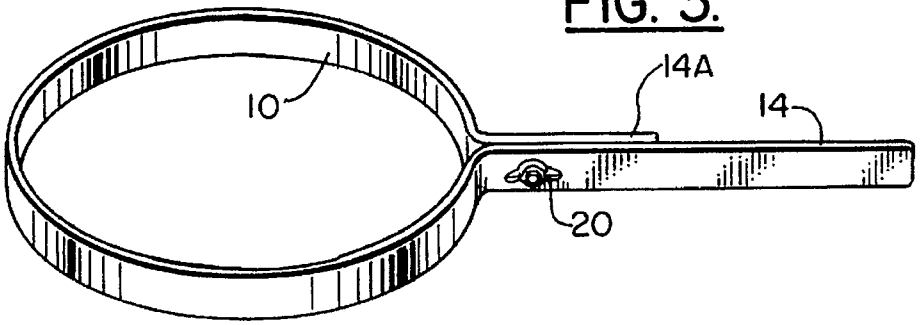
Figure 6B:
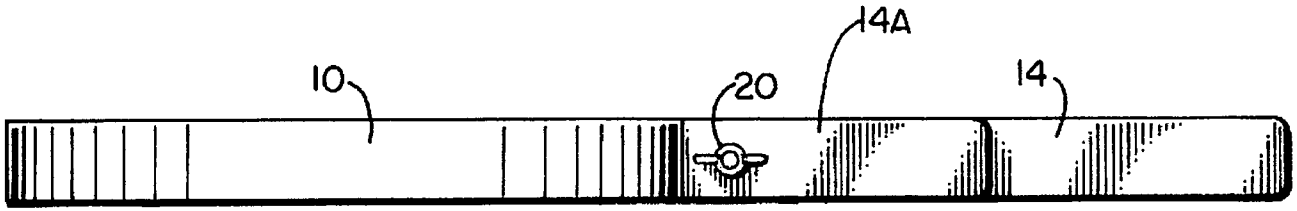
FIGS. 6A & 6B are top and side views, respectively, of the container holder but without the container.
Figure 6A:
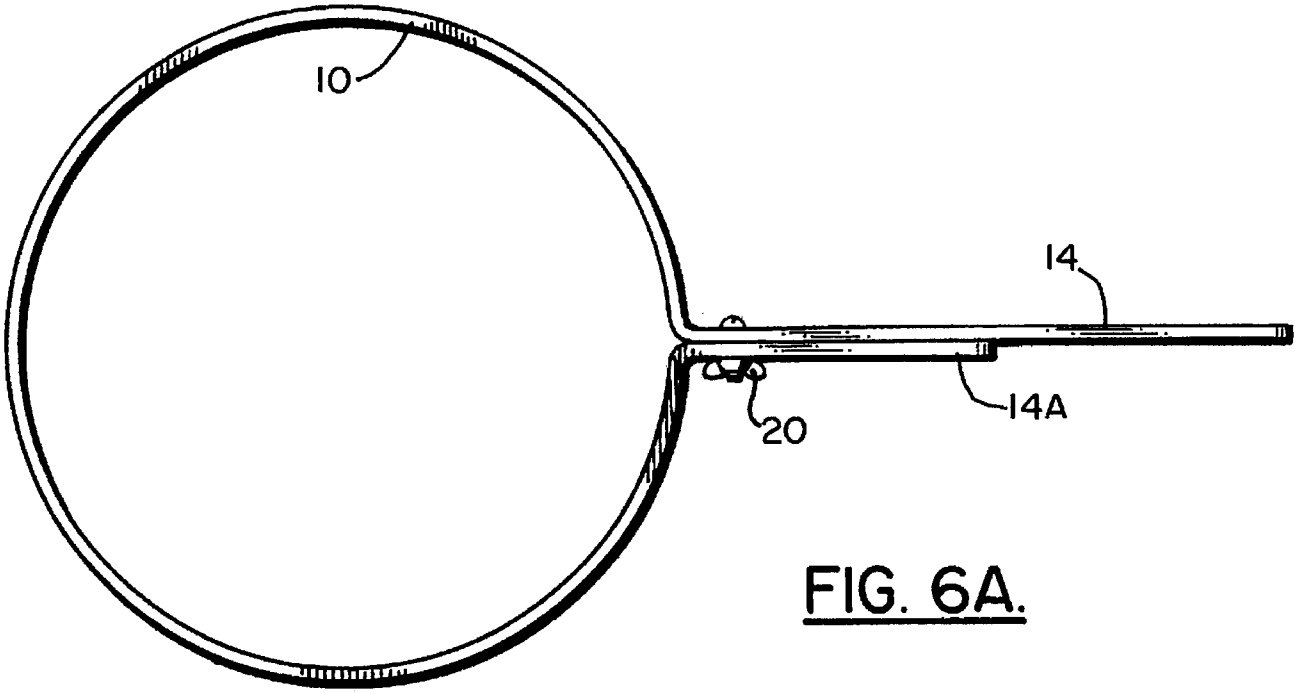

A preferred, exemplary embodiment of the simplified container holder of the present invention by itself is illustrated in FIGS. 3 and 6A & 6B and comprises a circular, cincture ring or contact band 10 of a flexible, preferably springy material to allow repeated tightening and loosening around a container 12, such as, for example, a gallon paint can. To secure the cincture band 10 tightly, a temporary fastener 20 (e.g. a wing nut and bolt) extends from side-to-side at the proximal point where the circular cincture 10 has made its complete circle and terminates in opposed arm members, a shorten arm member or stub 14A and a main, projecting arm 14, that is used for insertion into a selected one of the hollow rungs 18 of an exemplary ladder 16 (note FIGS. 1 & 2).

Figure 4:
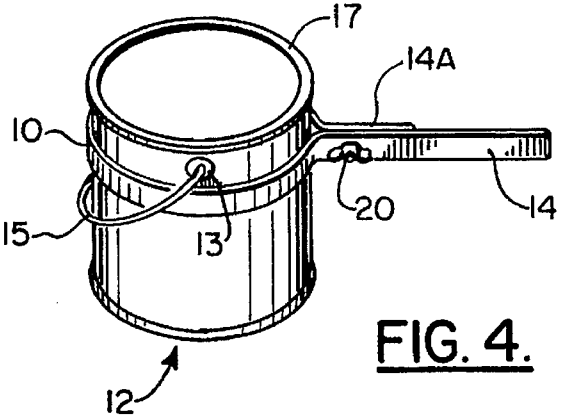
FIG. 4 is a perspective view similar to that of FIG. 3, but with the paint container being held by the container holder below the handle attachment protrusions on the side of the can.
Figure 5A:
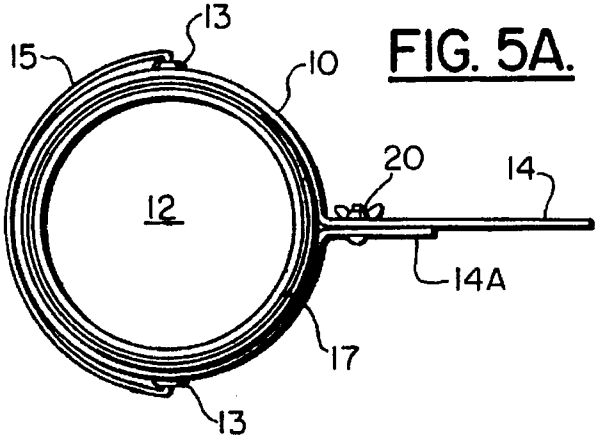
FIGS. 5A & 5B are top and side views, respectively, of the container holder secured around the container but with the cincture clamp positioned above the side handle attachment protrusions and below the container's top lip and with the top of the paint can shown in phantom line.
Figure 5B:
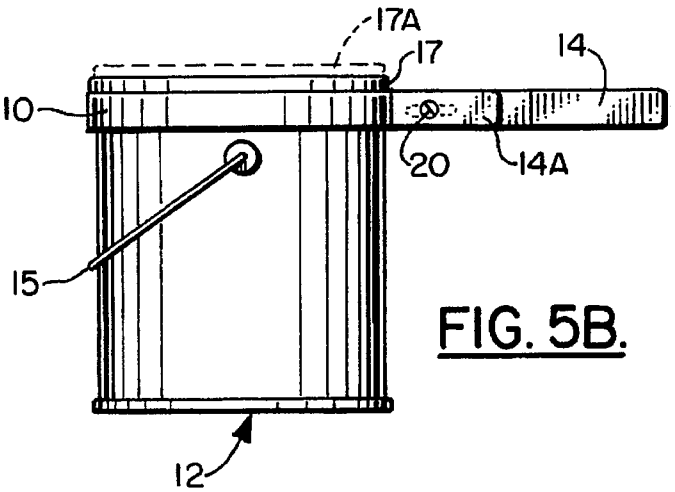

As can be seen in FIGS. 4 and 5A & 5B, the cincture holder 10 is secured in position around a container 12 in face-to-face engagement with the peripheral circumference of the cylindrically shaped container or paint can.

Figure 1:
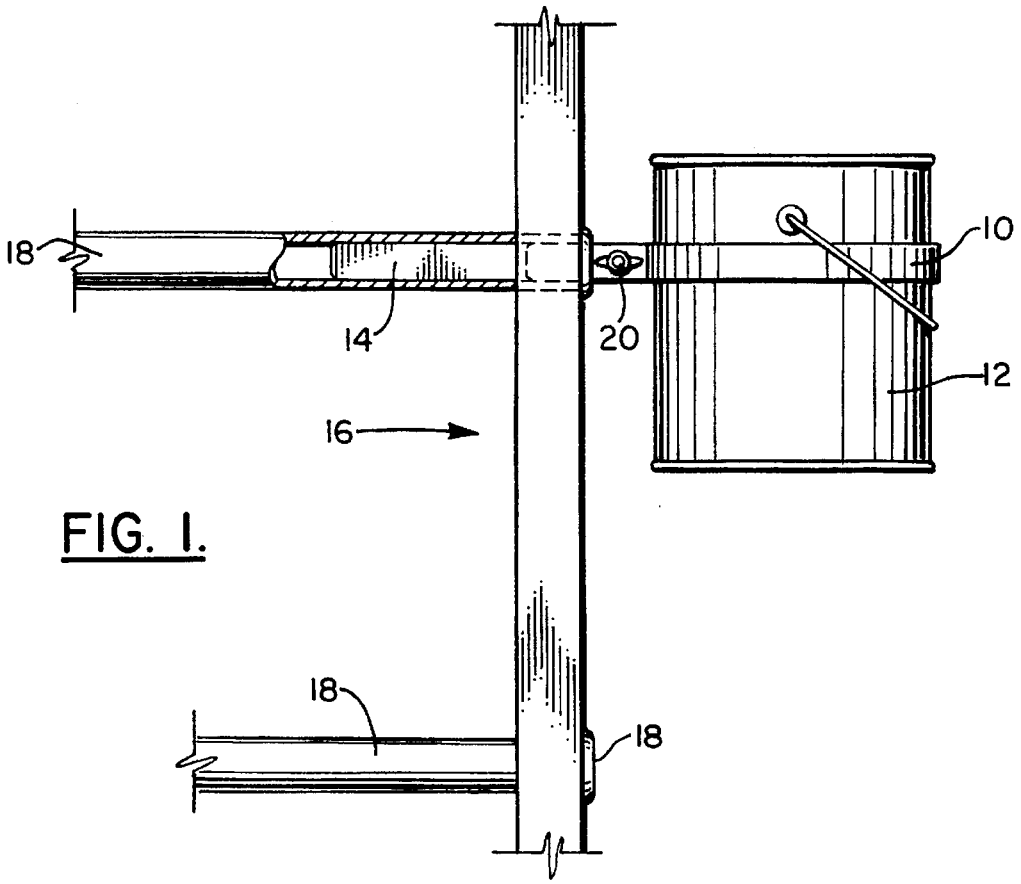

As can be further seen in FIGS. 1 & 2, the holder is then used to support the container 12 from a selected one of the hollow rungs 18 of the ladder 16.

The manner of using the container holder 10/14 of the invention is to secure the cincture 10 around the container 12 as illustrated in FIGS. 4 and 5A & 5B.

The position of the cincture 10 should be in the upper third section of the container 12, either just below the side handle protrusions 13 (FIG. 4) for the can handle 15 or between the side handle protrusions 13 and the laterally extended, top edge lip 17 of the container (FIG. 5B). As can be seen in FIG. 5B (note phantom lines), the top cap 17A can be freely put on and removed from the top of the container 12 when the container is in the full grip of the holder 10/14.

The cincture 10 is tightened by means of the fastener 20. The container 12 secured compressively within the cincture 10 has the integral projecting arm 14 projecting away from the container 12 at a right or orthogonal angle thereto, as though it were also an integral part of the container 12 itself. To use the container holder of the invention, the projecting arm 14 is inserted into a selected one of the hollow rungs 18 of the ladder 16 at a desired position as shown in FIGS. 1 & 2.

Positioning the cincture 10 on the upper third of the container 12 allows the weight of contents and container 12 to remain in an upright position. Container 12 will hang as a pendulum from the pivot axis of the laterally extended arm 14 inserted into the hollow rung 18 of the ladder 16.

The holder and container 12, forming a tightly combined unit, can be carried by the container's handle and moved to where it is needed. One hand only is required to handle it. A worker on a ladder 16 thus has one hand free "for the job" and one "for himself" to use in climbing or to change the position of the combined 10/14 holder and container 12.

By design the projecting arm 14 easily slides into or out of hollow ladder rung 18.

The holder 10/14 of the invention with the container 12 in it can be used on any ladder 16 with hollow rungs 18 and it is simple to change its location to any height or side location needed, all using only one hand to remove and/or slide the projecting arm 16 into the most convenient hollow ladder rung 18.

Exemplary dimensions for the holder are a single piece of continuous spring metal approximately twenty-two (22") inches long from end-to-end with a width of three-fourths (¾") of an inch and a thickness of one-eight (⅛") of an inch, which dimensions are of course subject to substantial variations. The continuous strip, made for example of spring metal, is bent into the appropriate configuration (as, for example, is illustrated inter alia in FIG. 6A) preferably with opposed holes made in the strip for the insertion of a bolt.

However, many different fasteners are available to hold the two ends of the cincture 10 together, some not requiring a bolt. Besides the wing nut and bolt arrangement described above, one could alternatively use, for example, a "U" shaped, resilient clip which fits and extends down across the width of the combined flat arm members 14, 14A, holding them together under the compressive force of the legs of the "U" shape. As a further, exemplary alternative a slip ring, which is compressively insertable over the over-lapped arm members could be used to fasten them together under compression.

The holder can be made of metal, an alloy, or plastic, or any other suitable material with the requisite strength and flexibility to appropriately encircle and support the container when filled.

While the present invention has been shown and described in what is at this time currently believed to be most the practical and preferred embodiment, it is recognized that departures may be made therefrom within the scope of the invention, which therefore is not to be limited to the details disclosed herein, but it is to be accorded the full scope of the claims as to embrace any and all equivalent devices and approaches.

Thus, the embodiment described herein in detail for exemplary purposes is subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A simplified container holder for supporting a cylindrically shaped, liquid container on a ladder, the container having a side, circular, peripheral circumference, said container holder comprising:

an at least generally flat, flexible, springy, encircling cincture extendable completely around the side peripheral circumference of the container in face-to-face, intimate engagement therewith, so as to completely encircle the container, said cincture being rigid across its width and having two, integral over-lapping arm members forming a contiguous, integral, rigid, projecting arm, made up of said two, over-lapping arm members which are insertable into a single hollow rung of a ladder, serving as a support for the container onto the ladder, the two ends of said cincture over-lapping with one another in flat, face-to-face engagement, said cincture and said projecting arm members being made of one, continuous strip of flat material, one of said integral arm members being substantially longer than the other, said longer arm member being insertable into the hollow rung of the ladder for supporting the container on the ladder; and fastening means holding said two, over-lapping ends together under compressive force and being located near their initial junction together and after the completely encircling cincture is formed by said continuous strip of flat material.

2. The simplified container holder of claim 1, wherein the container has side handle protrusions, and wherein:

said cincture is locatable to encircle about the container below and juxtaposed to the side handle protrusions.

3. The simplified container holder of claim 1, wherein the container has a laterally extended top lip and side handle protrusions, and wherein:

said cincture is locatable to encircle the container above the side handle protrusions and below the top lip.

4. A method of supporting a container, on a ladder, comprising the following steps:

(a) providing a simplified container holder, including an at least generally flat, flexible, springy, encircling cincture extendable completely around the side peripheral circumference of the container, said cincture being rigid across its width, a contiguous, rigid, projecting arm made up of two, over-lapping arm members, insertable into a single hollow rung of a ladder, the two, proximal ends of said cincture being substantially over-lappable with one another in flat, face-to-face engagement, said cincture and said arm members being made of a continuous, single piece of integral material, and fastening means for holding said two, over-lapping ends together under compressive force at a location near but downstream from their initial junction together;

(b) inserting the container into the open cincture and closing the arm members together into over-lapping relationship, until the cincture engages the peripheral circumference of the container in face-to-face, intimate engagement therewith, completely encircling it;

(c) bringing said two arm members together in face-to-face, substantially overlapping relationship and using said fastening means to hold said two, over-lapping arm members together under compressive force in a direction orthogonal to the geometrical plane defined by said two arm members when brought together; and (d) inserting at least one of said two fastening arm members into a hollow rung on the ladder, with the geometrical plane defined by said substantially over-lapped arm members being vertical to the ground, supporting said cincture and causing the holder to serve as a support for the container onto the ladder.

5. The method of claim 4, wherein there is further included the steps of:

moving said arm member out of the hollow rung of the ladder with one hand and re-inserting it into another hollow rung with the same one hand.

6. The method of claim 4, wherein the container has a top cap, and wherein there is further included the step of:

placing and securing the top cap onto the top of the container while the container is being encircled by the cincture.

7. The method of claim 4, wherein the container has side handle protrusion, and wherein there is further included the step of:

placing the cincture around the container below and in juxtaposition to the side handle protrusions.

8. The method of claim 4, wherein the container has side handle protrusions and a laterally projecting top edge lip, and wherein there is further included the step of:

placing the cincture around the container between the side handle protrusions and the laterally projecting top edge lip.

9. The method of claim 4, wherein there is further included the step of:

forming the cincture and the arm members from a single, continuous, integral strip of flat material appropriately folded to from the cincture and over-lapping arm members with the geometrical planes defined by said arm members and the lateral lines of said cincture being parallel to one another and vertical to the ground.

10. A simplified container holder for supporting a cylindrically shaped, liquid container on a ladder, the container having a side, circular, peripheral circumference, said container holder comprising:

an at least generally flat, flexible, springy, encircling cincture made of a continuous length of at least generally flat, stock material bent into a circular section and ending in two straight sections, said circular section being extendable completely around the side peripheral circumference of the container in face-to-face, intimate engagement therewith, completely encircling the container, said cincture being rigid across its width and having said two end straight sections forming two, integral, substantially over-lapping arm members forming a contiguous, integral, rigid, projecting arm, made up of said two, overlapping arm members which are of a size in combination which is insertable into a single hollow rung of a ladder, serving as a support for the container onto the ladder, the two ends of said cincture over-lapping with one another in flat, face-to-face engagement along a substantial part of their lengths, said cincture and said projecting arm members being made of one, continuous strip of flat, stock material, one of said integral arm members being substantially longer than the other, said longer arm member being insertable into the hollow rung of the ladder for supporting the container on the ladder; and fastening means holding said two, over-lapping ends together under compressive force and being located near their initial junction together and after the completely encircling cincture is formed by said continuous strip of flat material, the geometrical plane formed by said flat, substantially overlapping end sections and said lateral lines of said cincture parallel to each other when said ends are in their fastened together disposition.

11. The simplified container holder of claim 10, wherein the container has side handle protrusions, and wherein:

said cincture is locatable to encircle about the container below and juxtaposed to the side handle protrusions.

12. The simplified container holder of claim 10, wherein the container has a laterally extended top lip and side handle protrusions, and wherein:

said cincture is locatable to encircle the container above the side handle protrusions and below the top lip.

* * * * *